US006076918A

United States Patent [19]

Shima et al.

[11] Patent Number: 6,076,918

[45] Date of Patent: Jun. 20, 2000

[54] METHOD OF MANUFACTURING AN ELECTROSTATIC INK JET PRINTING HEAD WITH POINTED INK EJECTORS

[75] Inventors: Kazuo Shima; Junichi Suetsugu; Tadashi Mizoguchi; Hitoshi Minemoto; Hitoshi Takemoto; Yoshihiro Hagiwara; Toru Yakushiji, all of Niigata, Japan

[73] Assignee: NEC Corporation, Tokyo, Japan

[21] Appl. No.: 08/970,430

[22] Filed: Nov. 14, 1997

[30] Foreign Application Priority Data

Nov. 15, 1996 [JP] Japan ..... 8-304411

[51] Int. Cl.[7] ..... B41J 2/06

[52] U.S. Cl. ..... 347/55

[58] Field of Search ..... 347/116, 115, 347/20, 123, 40, 42, 55, 154, 103, 111, 159, 127, 128, 17, 141, 120, 151; 29/890.17; 216/54, 40, 41, 42

[56] References Cited

U.S. PATENT DOCUMENTS

| | | | |
|---|---|---|---|
| 5,141,459 | 8/1992 | Zimmerman . | |
| 5,285,055 | 2/1993 | Temple et al. | 216/40 |

FOREIGN PATENT DOCUMENTS

| | | |
|---|---|---|
| 0 703 081 | 3/1996 | European Pat. Off. . |
| 60-228162 | 11/1985 | Japan . |
| 8-149253 | 6/1996 | Japan . |
| 8-309993 | 11/1996 | Japan . |
| WO 93/11866 | 6/1993 | WIPO . |

*Primary Examiner*—John Barlow
*Assistant Examiner*—Raquel Yvette Gordon
*Attorney, Agent, or Firm*—Young & Thompson

[57] ABSTRACT

The ink ejecting parts of an electrostatic ink jet printing head are formed in conical pointed needle shapes protruding from an orifice plate and an orifice is provided individually for each ink ejecting point. An undercut phenomenon in an etching operation on an isotropic material is used, and the ink ejecting parts are formed in the conical and pointed needle shape protruding from the orifice plate.

1 Claim, 6 Drawing Sheets

METHOD OF MANUFACTURING AN ELECTROSTATIC INK JET PRINTING HEAD WITH POINTED INK EJECTORS

BACKGROUND OF THE INVENTION

1. Field of the Invention

The present invention relates to a printing head that adheres toner to a printing medium, and more particularly to an electrostatic ink jet printing head and a method for manufacturing it.

2. Description of the Related Art

One of the more popular printing methods recently is a non-impact printing method in which noise generated during printing is reduced to a negligible level. Ink jet printing has been deemed to be a particularly effective non-impact printing method and has a variety of advantages and effects as described below.

(1) The mechanism is simple and production cost is low.

(2) Printing can be done directly on a printing medium at high speed.

(3) A special printing medium is not necessary (plain paper can be used).

The above described ink jet printing method is preferable to other non-impact printing methods in view of ease in controlling the amount of ink. Therefore, it is anticipated that use of this printing method will increase.

Various kinds of ink jet printing methods have been propsed. For example, a method on the basis of heat, a method using a piezoelectric element, a method using an air flow, a method under the influence of an electrostatic force and so on have been proposed.

Ink jet printing methods depending on electrostatic force (an electrostatic ink jet printing method) are carried out by using ink having toner particles dispersed in a carrier liquid, applying voltage between needle shaped printing electrodes for ejecting the ink and counter electrodes provided on the rear surface of a printing sheet opposed to the needle shaped printing electrodes, and by propelling the ink under the influence of the electrostatic force of a generated electric field.

An example of an electrostatic ink jet printing head disclosed in Japanese Non-examined Patent Publication Sho 60-228162 will be described with reference to FIG. 6, which is a perspective view of the electrostatic ink jet printing head.

Referring to FIG. 6, a base plate 101 is made of a plate shaped insulating material. A plurality of printing electrodes 102 are formed at constant intervals with a desired resolution on the surface of the base plate 101. In addition, the printing electrodes 102 are so formed that the adjacent electrodes do not contact but are formed respectively as independent electrodes. An end of each printing electrode 102 is connected to a driver (not shown) applying respectively high voltage pulses to each electrode. The protrusions 103 are respectively formed at the ends of the printing electrodes 102. Ink ejecting openings 107 are formed slightly recessed from the protrusions 103. The cover 104 comprises an ink tank portion 105 so as to supply the ink to the ink ejecting openings 107. The supplied ink forms ink menisci at the end parts of the respective protrusions 103. Each of the independent electrodes 102 has one end at the side opposite to the ink ejecting side which is connected to the driver (not shown) as mentioned above. A high voltage pulse is selectively applied to the one end of each electrode from the driver in the course of a printing operation and a part of the ink meniscus is discharged or ejected by virtue of the electrostatic force, so that an ink droplet is propelled to a printing medium (not shown), fixed and recorded thereon.

However, the above described electrostatic ink jet printing head has the following problems.

Specifically, the ink located at the end parts of the protrusions 103 which serve as ink ejecting points is undesirably continued and connected together because of the presence of the ink menisci between the adjacent protrusions 103. As a result, a vibration generated on the liquid level of the ink meniscus at the ink ejecting point to which the high voltage pulse is applied and from which the ink droplet is ejected causes an adverse influence to be given to the ink at the end parts of the protrusions in the neighborhood thereof. Thus, ink droplets have been erroneously and disadvantageously ejected also from parts near to ink ejecting points where the ink droplets do not need to be ejected or forced out. Accordingly, the ink droplets have been unstably ejected. When the ink droplets are ejected irregularly, unnecessary ink droplets are propelled onto the printing medium and the contours of characters or figures to be printed have poor resolution.

Further, since the end parts of the protrusions 103 which act as the ink ejecting points are formed at positions retracted from the end part E of the base plate, there is a risk that the ink menisci are not formed in definitely or clearly protruding shapes at the ink ejecting points owing to the wetness of the end part E of the baseplate by the ink. When the ink menisci are not created in the protruding or convexed forms, an electric field generated by applying the high voltage pulse for ejecting the ink droplets has not been concentrated onto the end parts of the protruding or convexed shapes of the ink menisci, and therefore the ink has not been stably ejected or propelled. Consequently, there has also arisen a problem in that the ink droplets are ejected from parts other than the prescribed ink ejecting parts. In this case, the ink droplets have also been unstably ejected.

As stated above, according to the conventional electrostatic ink jet printing head, the unstable discharge or ejection of the ink, which results from the structure of the head and its ink ejecting points, has been generated, so that a beautiful and clear printing cannot be always carried out conveniently. Therefore, it has been desired to provide an electrostatic ink jet printing head capable of more stably ejecting ink.

SUMMARY OF THE INVENTION

Accordingly, it is an object of the present invention to provide an electrostatic ink jet printing head and a method for manufacturing the electrostatic ink jet printing head in which ink droplets can be stably ejected and a correct and beautiful printing job can be performed.

The present inventor studied the various problems in order to solve them, and learned that the ink droplets can be stably ejected by redesigning the structure of the ink ejecting points of the electrostatic ink jet printing head.

For overcoming the problems mentioned above, there is provided an electrostatic ink jet printing head comprising: a plurality of ink ejecting parts protruding from a head base plate whose surface is covered by printing electrodes; and an orifice plate having a plurality of orifices aligned with each ink ejecting part, ink being filled between the head base plate and the orifice plate.

Further, there is provided a method for manufacturing an electrostatic ink jet printing head comprising: preparing an isotropic material used for a head base plate; forming ink ejecting parts having conical shapes using an under-cut phenomenon when etching the isotropic material; preparing an orifice plate having a corresponding orifice for each ink ejecting part; and arranging the orifice plate so that at least one part of the end of each ink ejecting part extends from the orifice.

According to the present invention, since the ink ejecting parts of the electrostatic ink jet printing head are formed to protrude from a head base plate and the orifices are formed individually for each ink ejecting part, the ink droplets can be stably ejected.

That is to say, the ink menisci are not interconnected and each ink meniscus is individually formed in a stable shape at the end of each ink ejecting part, so that each ink droplet can be accurately ejected without affecting the others. In addition, because the vibration of the ink menisci near the point from which the ink droplet is ejected is damped owing to the presence of the orifices, the ink droplets can be stably ejected and also prevented from being erroneously ejected from parts other than the ink ejecting parts.

Further, the undercut phenomenon in the etching operation of the isotropic material is employed, so that the ink ejecting parts can be easily formed in conical and pointed needle shapes protruding from the orifice plate.

DETAILED DESCRIPTION OF PREFERRED EMBODIMENTS

In the electrostatic ink jet printing head according to the present invention, the ink ejecting parts are independent of each other. An orifice plate has orifices formed in the shapes of circular through holes. The orifices corresponding to the ink ejecting parts are formed individually for the respective ink ejecting parts on the orifice plate so that ink droplets can be prevented from being erroneously ejected from parts other than those from which the ink needs to be ejected. The end parts of the ink ejecting parts which serve as ink ejecting or discharging points protrude from the end face of the orifice plate so that each ink meniscus can be reliably formed in protruding or convex shapes, in order to stabilize the ejection of the ink droplets. The ends of the ink ejecting parts are formed in the shape of conical and pointed needles. Owing to these structures, the ink menisci can be stably formed. As a result, the ink can be stably ejected.

An isotropic material is employed for a head base plate and an undercut phenomenon is utilized in order to manufacture or produce members for forming the ink meniscus.

Figure 1:
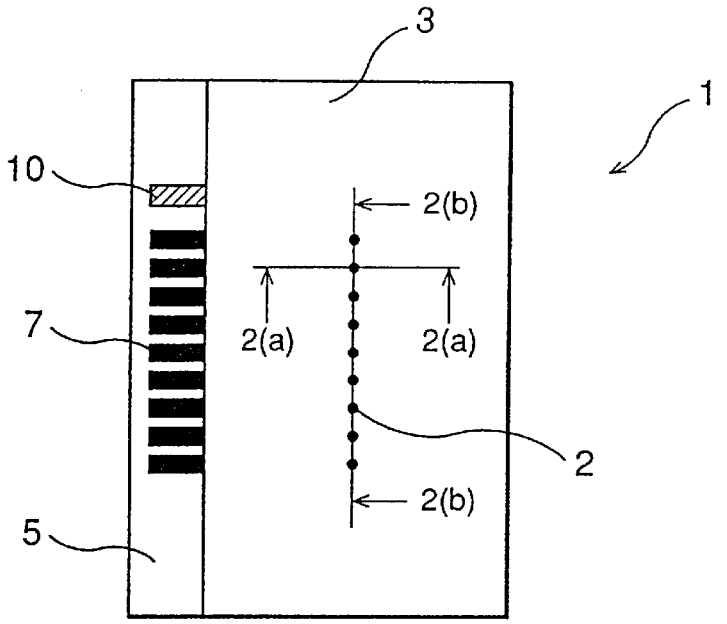
FIG. 1(*a*) is a plan view of an electrostatic ink jet printing head according to the present invention, and FIG. 1(*b*) is a plan view showing an inner part when the orifice plate shown in FIG. 1(*a*) is removed.
Figure 1:
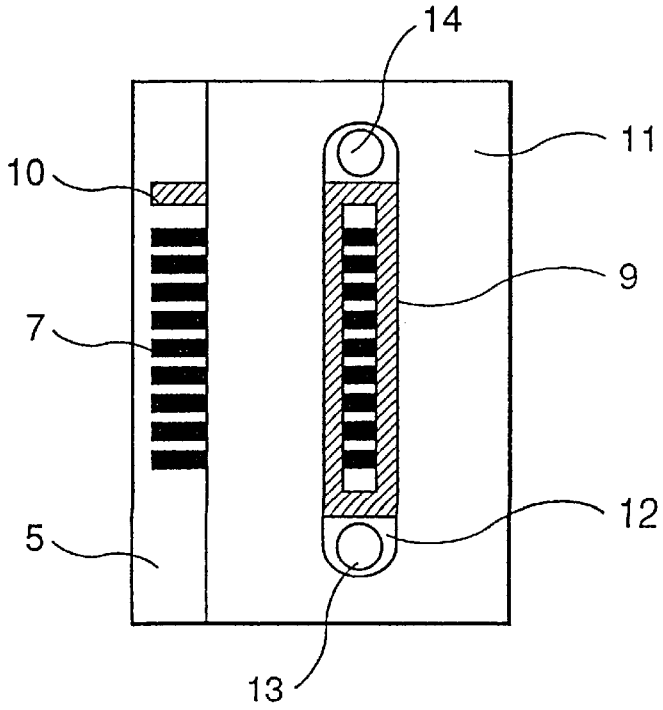
Figure 2:
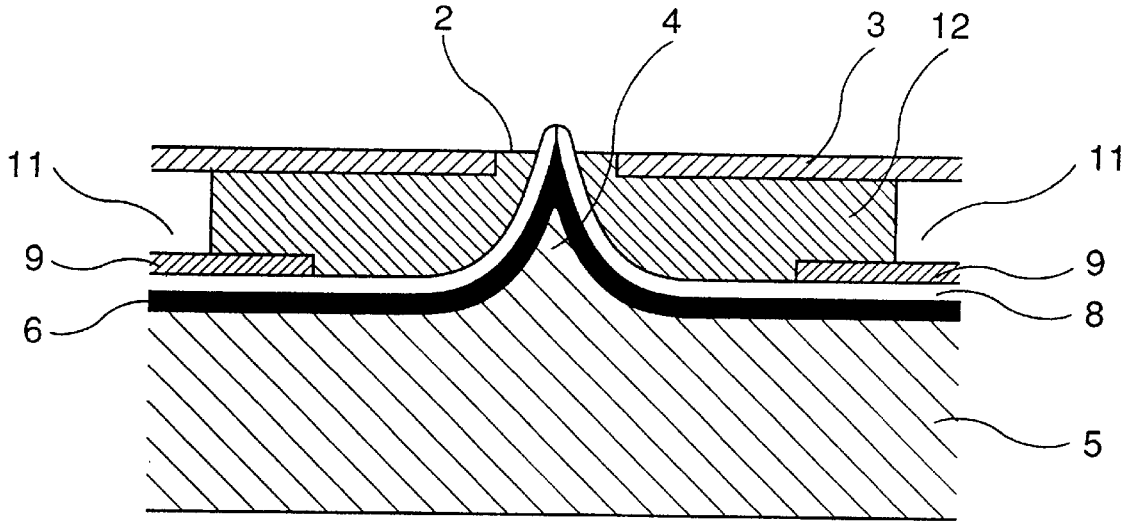
FIG. 2(*a*) is a sectional view of the electrostatic ink jet printing head according to the present invention taken along a line 2(*a*)—2(*a*) in FIG. 1(*a*) and FIG. 2(*b*) is a sectional view taken along a line 2(*b*)—2(*b*) in FIG. 1(*a*).
Figure 2:
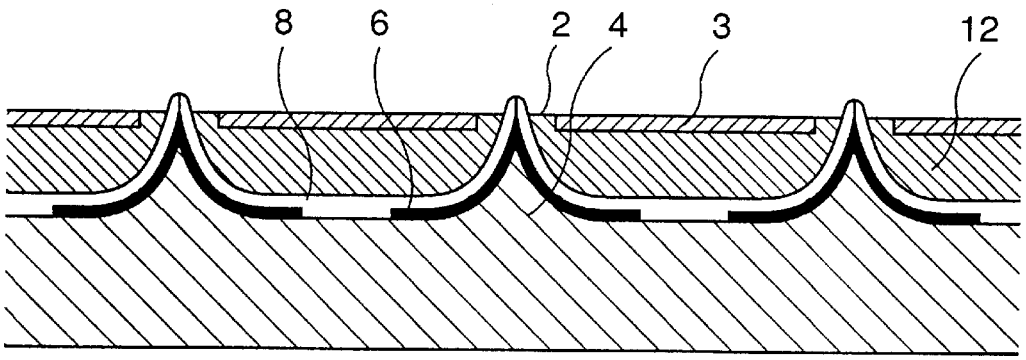

As illustrated in FIG. 1(*a*), a printing head 1 according to the present invention comprises an orifice plate 3 having a plurality of orifices 2 and a head base plate 5 having a plurality of ink ejecting parts 4 (see FIG. 2(*a*)). The orifice plate 3 is made as a thin plate or film of insulating material with a thickness of several tens to several hundreds of $\mu$m. To prevent unstable ink menisci because of the wetness of outer side of orifice plate with the ink, it is preferred that at least the outside of the orifice plate 3 has moderate ink repellency. On the orifice plate 3, orifices 2 formed as circular through holes having a diameter with an aspect ratio of not smaller than 1 relative to the thickness of the orifice plate 3 are formed at prescribed intervals corresponding to a desired resolution. The number of orifices to be formed corresponds to the desired number of dots. In this connection, the orifices 2 on the orifice plate 3 may be formed or divided into a plurality of rows in order to attain the desired resolution and desired number of dots.

The head base plate 5 is made of an insulating and isotropic material such as ceramic or glass. As illustrated in FIG. 2(*a*), a plurality of ink ejecting parts 4 are formed at positions of plate 5 corresponding to the orifices 2 formed on the orifice plate 3. Further, on the head base plate 5, a plurality of printing electrodes 6 are formed which are each independent of the others and are not in contact with the others (FIG. 1(*b*) and FIG. 2(*b*)). While each of the printing electrodes 6 is so formed as to cover the surface a corresponding one of the conical ink ejecting parts 4, the end part of each printing electrode 6 is formed as an electrode pad part 7 to be connected to a driver (not shown) for driving the printing electrode. The printing electrode 6 does not necessarily cover all parts of the ink ejecting part 4, but should cover at least the end region of the ink ejecting part where the ink meniscus is formed.

The printing electrodes 6 provided on the head base plate 5 are completely insulated and coated with an insulating coating material 8, except the electrode pad parts 7.

As illustrated in FIG. 1(*b*), mitigation electrodes 9 are formed with a metal plate such as Cu, Ni and overlie the printing electrodes except in the region of the ink ejecting parts 4 and the electrode pad parts 7 on the head base plate 5, and include a terminal part 10 to be connected to a mitigation voltage source (not shown).

The orifice plate 3 is aligned with the head base plate 5 such that the center of each of the orifices 2 of the orifice plate 3 coincides with the end part of each of the ink ejecting parts 4 on the head base plate 5. The end of each ink ejecting part 4 protrudes to a predetermined extent, for example, a length sufficient to form an ink meniscus at each orifice 2, with an ink partition wall 11 sandwiched therebetween. It is preferable for ejecting small ink droplets that the diameter of the portion of the ink ejecting part protruding from the orifice is smaller than 100 $\mu$m, preferably smaller than 20 $\mu$m. Further, a clearance is provided between the inner periphery of each orifice 2 and each ink ejecting part 4 all around the ink ejecting part 4. Consequently, the ink meniscus clinging to the ink ejecting part 4 is formed seperately from any ink meniscus clinging to the corresponding orifice 2, and the ink menisci at the ink ejecting part 4 are stably formed. The outer side of the orifice plate 3 is not readily wetted with the ink because at least the exterior of the orifice plate 3 has a moderate ink repellency and the ink can hardly flow from the orifice 2. In addition, a flow path 12 (FIG. 2(*b*)) is formed between the orifice plate 3 and the head base plate 5 under the presence of the ink partition wall 11. While one end part of the flow path 12 is connected to an ink supply port 13 (FIG. 1(*b*)), the other end of the flow path 12 is connected to an ink exhaust port 14. The ink supply port 13 and the ink exhaust port 14 are respectively connected to an ink tank (not shown) through a pump (not shown), so that the ink in the printing head 1 is circulated through the flow path 12. The depth of the flow path 12 is sufficient for the ink to flow freely and for the ink of desired concentration to be supplied to every end portion of the ink ejecting parts 4. In particular, the depth of the flow path 12 is preferably at least about 0.2 mm.

Figure 3:
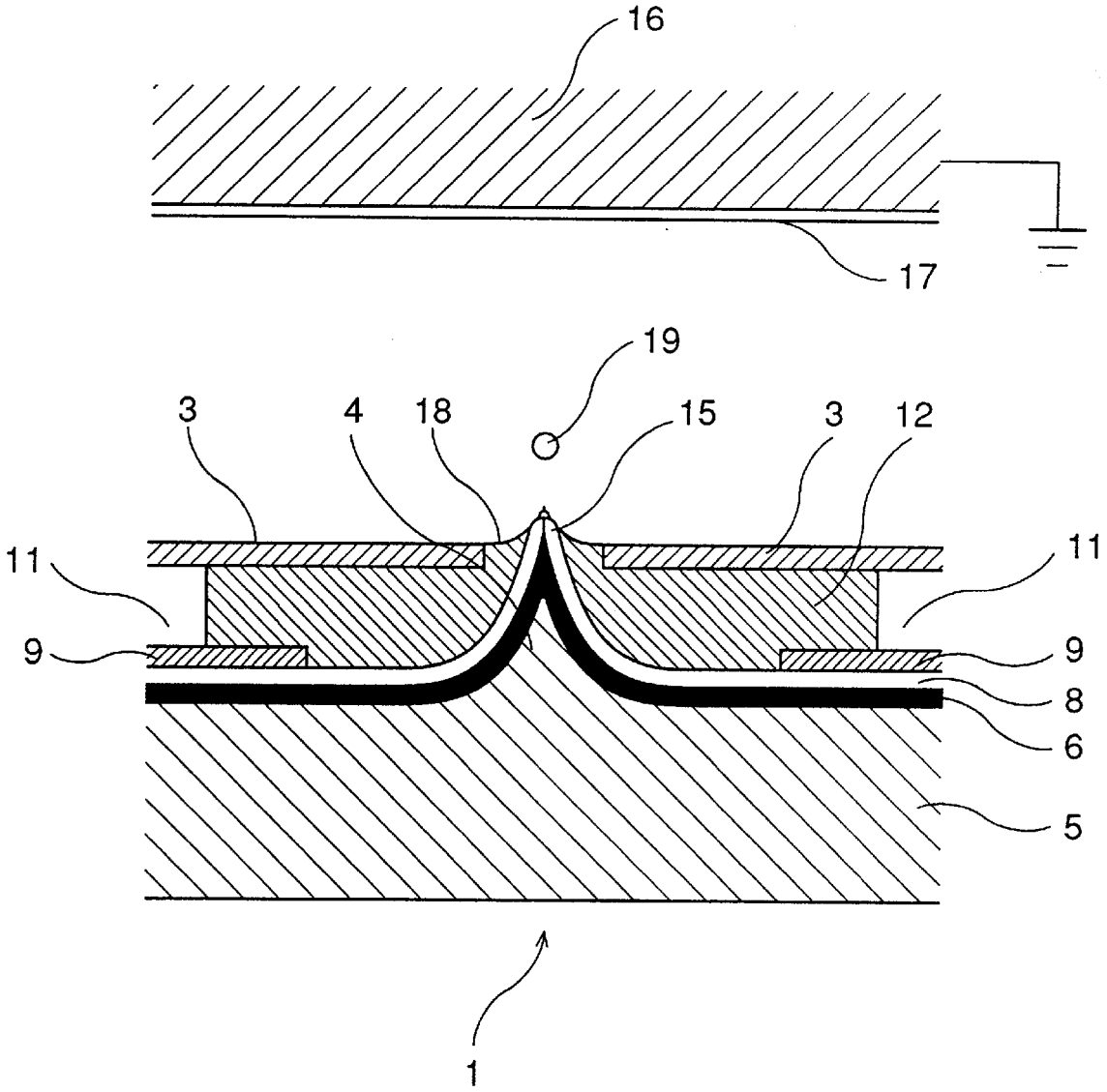
FIG. 3 explains the driving method of the electrostatic ink jet printing head according to the present invention.

A drive mechanism for ejecting the ink from the electrostatic ink jet printing head will now be described with reference to FIG. 3.

An opposed electrode 16 is arranged, with a prescribed gap provided from an ink ejecting point 15, at a position opposed to the orifice plate 3 of the printing head 1. A printing sheet 17 (e.g., paper) is fed until it comes into contact with the opposed electrode 16 which serves as a platen, while the printing sheet 17 maintains the prescribed gap from the ink ejecting point 15. The opposed electrode 16 is set to a ground level, or set to a bias voltage having a polarity reverse to that of toner particles dispersed in the ink. The printing sheet 17 fed onto the opposed electrode 16 is electrically charged to a potential equal to that of the opposed electrode 16.

When a printing operation is on stand by, the bias voltage having a polarity the same as that of the toner particles dispersed in the ink is applied to the mitigation electrodes 9 so that the ink is not prematurely discharged or forced out from the ink ejecting point 15. The ink flowing in the flow path 12 is electrically charged to a potential the same as that of the mitigation electrodes 9. Additionally, the toner particles dispersed in the ink flowing in the flow path 12 are moved and circulated so as to be concentrated at the ink points 15 on the orifices 2 under the influence of an electric field between the ink and the opposed electrode 16. Owing to the presence of the mitigation electrode 9, the ink is quickly charged to be ejected and the ejecting of the ink is easily controlled by the voltage and the pulse width of high voltage applied to the printing electrode 6.

During a printing operation, a pulse voltage having a polarity the same as that of the toner particles distributed in the ink is applied to the printing electrode 6 formed on the ink ejecting part 4 corresponding to a desired printing character. Then, an electrostatic force is exerted on the toner particles dispersed in the ink on the ink ejecting point 15 under the influence of the electric field generated between the printing electrode 6 and the opposed electrode 16. The electrostatic force exerted on the toner particles overcomes the surface tension of an ink meniscus 18 formed on the ink ejecting point 15. Thus, an ink droplet 19 including the toner particles on the ink ejecting part 15 is ejected or forced out toward the opposed electrode 16, so that a character printing is carried out on the printing sheet 17. On the printing sheet 17, dots are formed such that the ink droplets including the toner particles land on the printing sheet. The applied ink droplets including the toner particles are fixed onto the printing sheet 17 by means of a fixing mechanism (not shown) such as a heat roller.

As described above, in the electrostatic ink jet printing head according to the present invention, the end of each ink ejecting part protrudes from the central part of a corresponding circular orifice passing through the orifice plate. Therefore, an ink meniscus is reliably extended or made convex at the end of the ink ejecting part, so that the ink droplet can be accurately ejected. In addition thereto, owing to the presence of the orifice plate having the orifices, the ink droplets can be prevented from being erroneously ejected from parts other than the ink ejecting parts, due to vibration of the ink menisci near to the point from which the ink droplet is ejected.

An embodiment of manufacturing the ink ejecting parts and the printing electrode parts of the electrostatic ink jet printing head according to the present invention will now be described.

As mentioned before, according to the electrostatic ink jet printing head of the present invention, the ink ejecting parts protrude from the surface of the end part of the base plate in order to stably form the ink menisci. Such an ink jet printing head has not been conventionally employed. The ink ejecting parts need to be three-dimensionally formed in order to manufacture them so as to protrude from the surface of the end of the base plate. Accordingly, it has been difficult to manufacture the ejecting parts according to the conventional manufacturing method.

Figure 4:
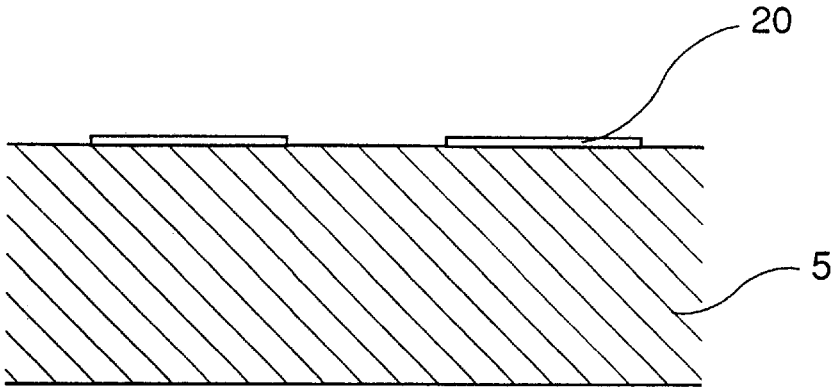
FIGS. 4(*a*)–4(*c*) show the manufacturing steps of the head base plate of the electrostatic ink jet printing head according to the present invention.
Figure 4:
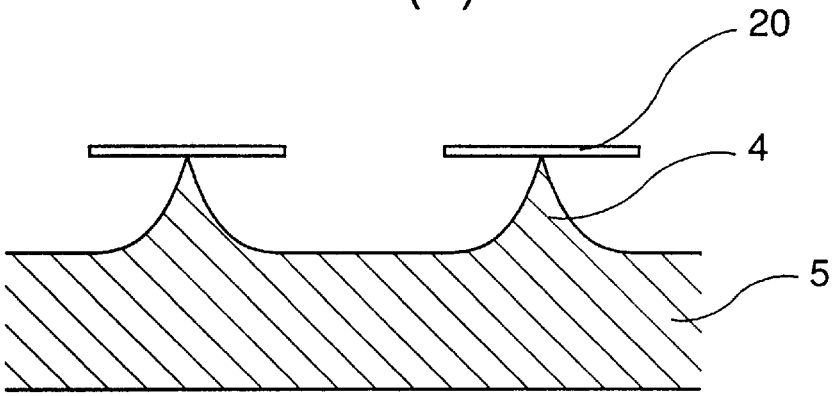
Figure 4:
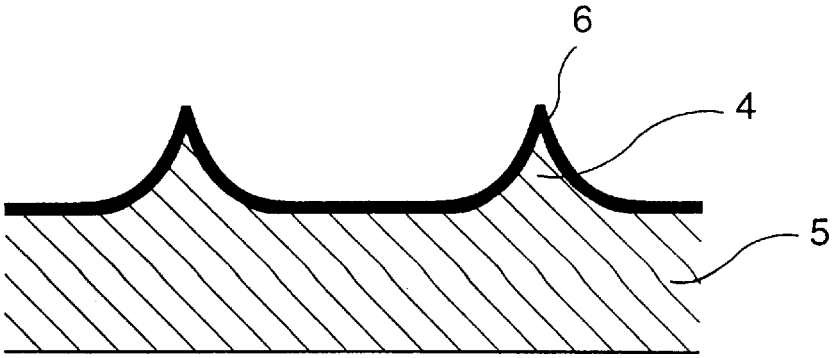

FIG. 4(*a*), 4(*b*), 4(*c*), 5(*a*), 5(*b*), and 5(*c*) respectively show the manufacturing processes of the head base plate of the present invention and are sectional views of the base plate in the respective processes. Initially, as illustrated in FIG. 4(*a*), a plurality of circular resist films 20 are formed around positions corresponding to the end parts of the respective ink ejecting parts so as to achieve a desired resolution on the base plate 5 of isotropic and insulating material such as ceramic or glass, by a photo-fabrication method using a photosensitive resist.

Next, as illustrated in FIG. 4(*b*), an etching liquid that selectively etches the material of the head base plate 5 but does not etch resist film 20 is sprayed onto the surface on which the resist films 20 are formed. At this time, a phenomenon referred to as "undercut", occurs, wherein the etching liquid rotates or circulates beneath the resist films 20 supported by support film (not shown) in proportion to an etching time in the isotropic material such as ceramic or glass used as the material of the head base plate 5, so that an etching operation is carried out. A plurality of conical ink ejecting parts 4 can be readily formed on the head base plate 5 by using this technique. Further, when the height of each of the ink ejecting parts 4 needs to be controlled, it can be easily controlled to a desired height by changing the diameter of each of the resist films 20.

Next, as illustrated in FIG. 4(*c*), after the resist films 20 formed on the head base plate 5 are removed, a metal layer constituting the printing electrodes 6 is formed overlying the ink ejecting parts 4 of the head base plate 5 by a method such as sputtering or ion-plating.

Figure 5:
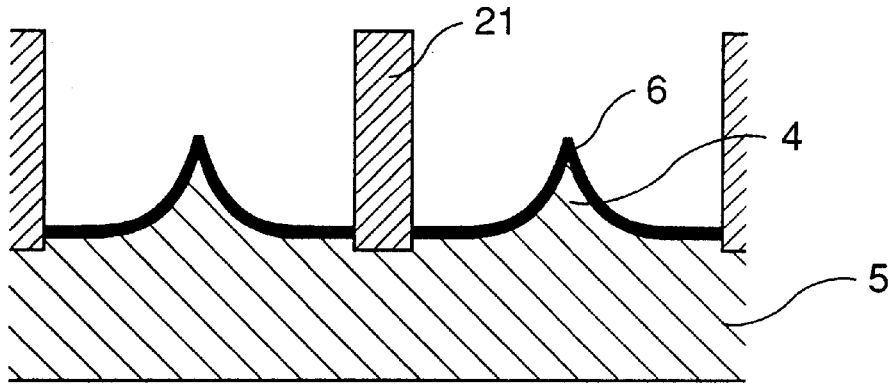
FIGS. 5(*a*)–5(*c*) show the manufacturing steps of the head base plate of the electrostatic ink jet printing head according to the present invention.
Figure 5:
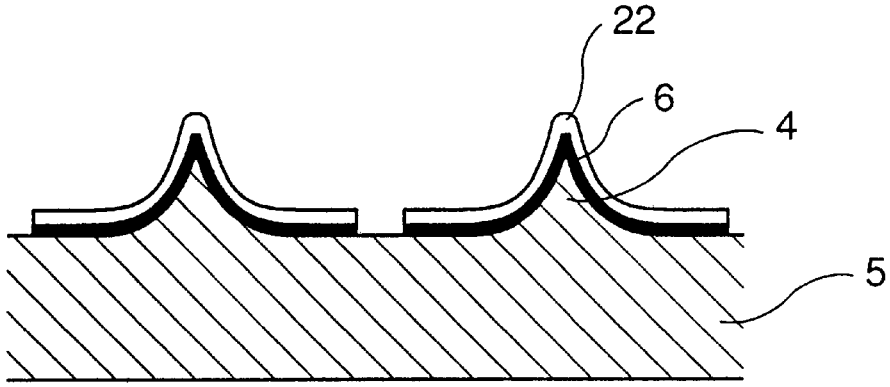
Figure 5:
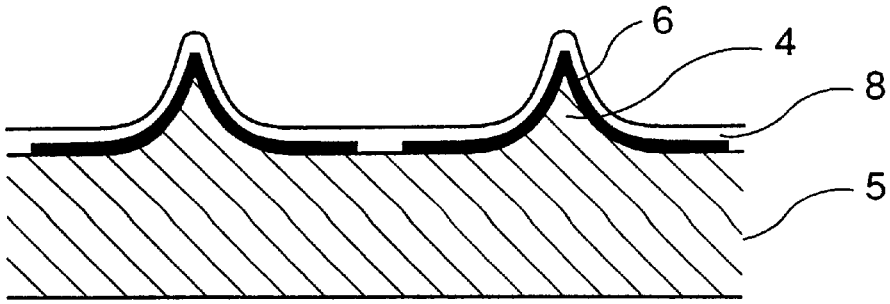
Figure 6:
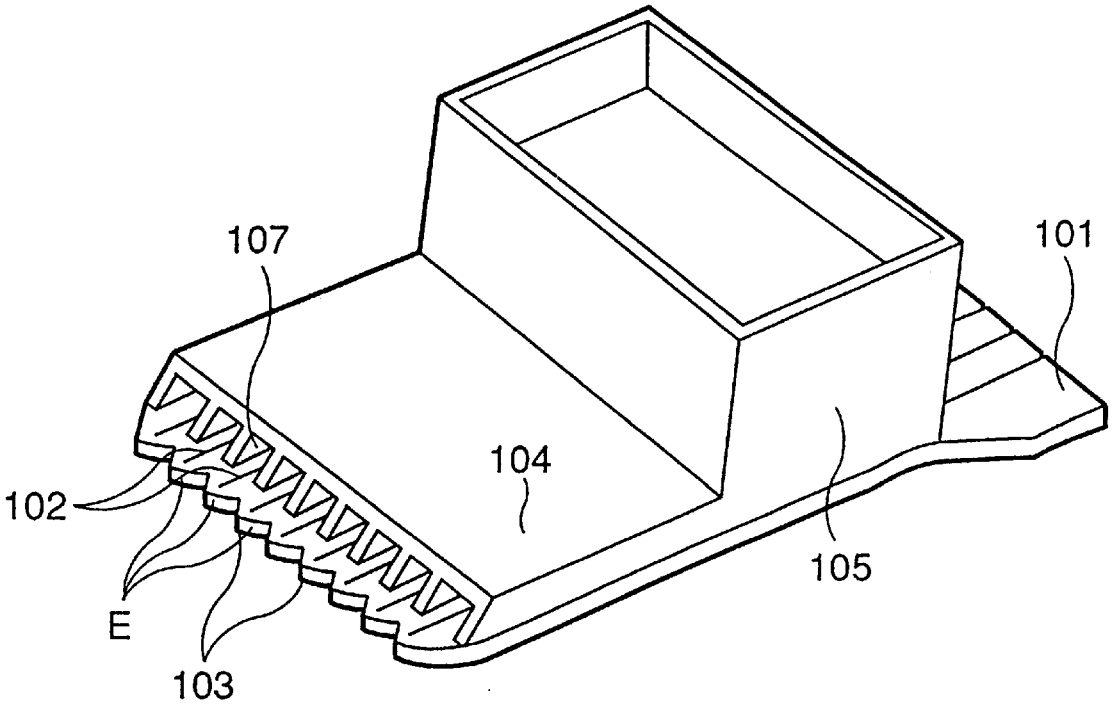
FIG.6 PRIOR ART
FIG. 6 is a perspective view of a conventional electrostatic ink jet printing head.

Next, the above mentioned metal layer is made independent for each ink ejecting part 4 so that the printing electrodes 6 are obtained. The method for forming the printing electrodes can be done by either of two techniques as illustrated in FIG. 5(*a*) and FIG. 5(*b*). FIG. 5(*a*) shows a method for making the metal layer independent for each ink ejecting part 4 and forming the printing electrodes 6 by dicing or cutting the side of the ink ejecting parts 4 adjacent to each other on the head base plate 5 on which the metal layer is provided by using a blade 21 depending on a desired slot width.

Another method is a photo-fabrication method using a photosensitive resist as shown in FIG. 5 (*b*). According to this method, resist films 22 patterned to the shapes of desired printing electrodes 6 are formed so as to independently remain on the respective ink ejecting parts 4 of the head base plate 5, the metal layer is etched by using an etching liquid having an etching feature and then, the remaining resist films 20 are removed.

Finally, as illustrated in FIG. 5(*c*), an insulating coating material 8 is applied over the ink ejecting parts 4 and the printing electrodes 6 of the head base plate 5 so that a completely insulated and coated film is formed.

As stated above, the electrostatic ink jet printing head is manufactured by forming the ink ejecting parts in the shapes of conical and pointed needles employing the photofabrication method and the etching method depending on the isotropic material, so that the ink ejecting parts can be easily projected from the end part of the base plate (orifice plate). Thus, the ejection of ink can be stabilized.

While the present invention has been described in connection with various preferred embodiments thereof, it is to be expressly understood that these embodiments are not to be construed in a limiting sense. Instead, numerous modifications and substitutions of equivalent structure and techniques will be readily apparent to those skilled in this art after reading the present application. All such modifications and substitutions are considered to fall within the true scope and spirit of the appended claims.

What is claimed is:

1. A method of manufacturing an electrostatic ink jet printing head, comprising the steps of:

providing a head base plate of isotropic material;

applying an etch resist to the head base plate in a pattern that defines locations of conical ink ejecting parts, the etch resist pattern including circles of etch resist whose diameters are a function of a desired height of the conical ink ejecting parts;

undercut etching the head base plate with an etching liquid that etches the head base plate beneath the etch resist applied thereto to form the conical ink ejecting parts;

providing an orifice plate with plural ink holes, each of the ink holes corresponding to one of the conical ink ejecting parts; and joining the orifice plate and the head base plate so that each of the conical ink ejecting parts has an apex that projects into a respective one of the ink holes.

* * * * *